US006386392B1

(12) United States Patent
Argentieri et al.

(10) Patent No.: US 6,386,392 B1
(45) **Date of Patent: *May 14, 2002**

(54) RESERVOIRS FOR USE WITH CLEANING DEVICES

(75) Inventors: Andrea Argentieri, Ixelles (BE); Yvon Loic Crozet, Rome (IT); John Russell Lawson, Cincinnati, OH (US); Patrizio Ricci, Grimbergen (BE); Jelle Dankert Vuijk, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/577,416

(22) Filed: May 22, 2000

Related U.S. Application Data

(63) Continuation-in-part of application No. 09/553,226, filed on Apr. 20, 2000.

(60) Provisional application No. 60/199,444, filed on Apr. 25, 2000, and provisional application No. 60/162,935, filed on Nov. 2, 1999.

(30) Foreign Application Priority Data

Dec. 1, 1999 (EP) ..... 99870246

(51) Int. Cl.[7] ..... B67D 5/00

(52) U.S. Cl. ..... 222/81; 222/85; 222/325

(58) Field of Search ..... 222/81, 105, 82, 222/85, 183, 325; 251/149.1

(56) References Cited

U.S. PATENT DOCUMENTS

| | | | |
|---|---|---|---|
| 3,092,106 | A | 6/1963 | Butler |
| 3,131,712 | A | 5/1964 | Risley |
| 3,200,994 | A | 8/1965 | Levinson |
| 3,542,240 | A | 11/1970 | Solowey |
| 3,685,694 | A | 8/1972 | Ianelli |
| 3,828,973 | A | 8/1974 | Birrel |
| 3,952,918 | A | 4/1976 | Poitras |
| 3,953,902 | A | 5/1976 | Taylor |
| 3,995,772 | A | 12/1976 | Laiutaud |
| 4,173,295 | A | 11/1979 | Steinmann |
| 4,699,188 | A | 10/1987 | Baker |
| 5,020,220 | A | 6/1991 | Miyake |
| 5,086,950 | A | 2/1992 | Crossdale |
| 5,104,003 | A | 4/1992 | Stecoza |
| 5,425,528 | A | 6/1995 | Rains |
| 5,435,462 | A | 7/1995 | Fujii |
| 5,732,853 | A | 3/1998 | Ganzeboom |

(List continued on next page.)

FOREIGN PATENT DOCUMENTS

| | | |
|---|---|---|
| CA | 2007887 | 7/1990 |
| CA | 2008148 | 7/1990 |
| CA | 2075473 | 8/1991 |
| CA | 2091020 | 10/1993 |
| CA | 2157597 | 9/1994 |
| CA | 2133238 | 4/1995 |
| EP | 0 369 722 B1 | 5/1990 |
| GB | 2 264 702 | 9/1993 |
| GB | 2 339 772 | 2/2000 |
| WO | WO 83/00932 | 3/1983 |

*Primary Examiner*—Philippe Derakshani
*Assistant Examiner*—Thach H. Bui
(74) *Attorney, Agent, or Firm*—Thibault Fayette; James C. Vago

(57) ABSTRACT

A reservoir for use with a dispensing appliance for spraying a liquid is provided, wherein the dispensing appliance comprises a protecting plate and at least two needles for engaging the reservoir. The protecting plate has a locked position and an unlocked position, wherein the protecting plate is movable in the unlocked position to expose the needles and is immovable in the locked position. The reservoir comprises a finish with an opening which communicates with the interior of the reservoir and a membrane disposed across the opening, wherein the membrane has an exposed length of less than about 45 mm.

25 Claims, 11 Drawing Sheets

1B

U.S. PATENT DOCUMENTS 5,816,449 A * 10/1998 Tanno et al. ..... 222/105
5,827,486 A 10/1998 Crossdale
5,842,682 A * 12/1998 Schennum et al. ..... 251/149.1
5,875,921 A 3/1999 Osgar
5,896,898 A 4/1999 Crossdale
5,967,197 A * 10/1999 Shown ..... 222/81
D424,167 S 5/2000 Yuen
6,095,370 A 8/2000 Rhine
6,109,480 A 8/2000 Monsrud
6,152,327 A 11/2000 Rhine

* cited by examiner

RESERVOIRS FOR USE WITH CLEANING DEVICES

CROSS REFERENCES TO RELATED APPLICATIONS AND PATENTS

This application is a continuation-in-part of U.S. patent application Ser. No. 09/553,226 filed Apr. 20, 2000, the substance of which is hereby fully incorporated herein by reference. This application is also related to provisional patent application Ser. Nos. 60/199,444 entitled Cleaning Implements filed Apr. 25, 2000 by Kunkler et al.; 60/162,935 filed Nov. 2, 1999 by Policicchio et al.; non-provisional patent application Ser. No. 29/122,301 entitled Bottle filed Apr. 25, 2000 by Hague et al; 29/122,313 entitled Floor Mop filed Apr. 25, 2000 by Kunkler et al; 09/201,618 entitled A Gear Pump and Replaceable Reservoir For A Fluid Sprayer filed Nov. 30, 1998 by Benecke; 09/557,020 entitled A Device With Improved Fitment System filed Apr. 20, 2000 by Lawson et al.; 09/553,038 entitled A Process For Cleaning Carpets And The Like filed Apr. 20, 2000 by Lawson et al.; 09/485,031 entitled A Packaged Product filed Feb. 2, 2000 by Lawson et al.; and U.S. Pat. No. 5,888,006, the substances of which are hereby fully incorporated herein by reference.

FIELD OF THE INVENTION

The present invention relates to reservoirs for use with cleaning implements, and, more particularly, to reservoirs for use with cleaning implements having hollow needles for venting and fluid transfer.

BACKGROUND OF THE INVENTION

Spray devices are known for the purposes of domestic cleaning, for example for cleaning hard surfaces such as windows, baths and ovens, as well as for spot cleaning of floor coverings such as carpets. Most spray devices which are commercially available are manually or electrically operated, that is to say that the devices comprise a pump which is activated or operated by the consumer. Most commonly this activation generates liquid pressure in a chamber by means of a positive displacement pump which in turn drives the liquid from the chamber usually through a dispensing nozzle. Many dispensing patterns are possible, but a conical spray is the most common. Usually, such spray devices comprise a reservoir filled with an active composition, and a means to dispense the composition from within said reservoir. The spray devices typically further comprise a basic fitment system to secure the reservoir onto the dispensing means, so as to establish a fluid communication between the two.

While solving some issues, the above mentioned inventions still present some disadvantages. After removing the reservoir from the appliance, the needle is accessible by anyone who would put his hand into the appliance's recess. Such needles are typically very sharp, and likely to cause injury upon contact, more particularly if some dispensed product remains on it. This is true for any type of user, but especially true for children. Indeed, it has been shown that children are very curious and while playing, they tend to put their hands into the recess of the dispensing appliance. Consequently, there is a desire to provide reservoirs suitable for use with a dispensing appliance which cooperate with a protecting means on the dispensing appliance, wherein the protecting means prevents access to a needle of the dispensing appliance when the reservoir is removed from the appliance.

SUMMARY OF THE INVENTION

A reservoir for use with a dispensing appliance for spraying a liquid is provided, wherein the dispensing appliance comprises a protecting plate and at least two needles for engaging the reservoir. The protecting plate has a locked position and an unlocked position, wherein the protecting plate is movable in the unlocked position to expose the needles and is immovable in the locked position. The reservoir comprises a finish with an opening which communicates with the interior of the reservoir and a membrane disposed across the opening, wherein the membrane has an exposed length of less than about 45 mm.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Figure 1A:
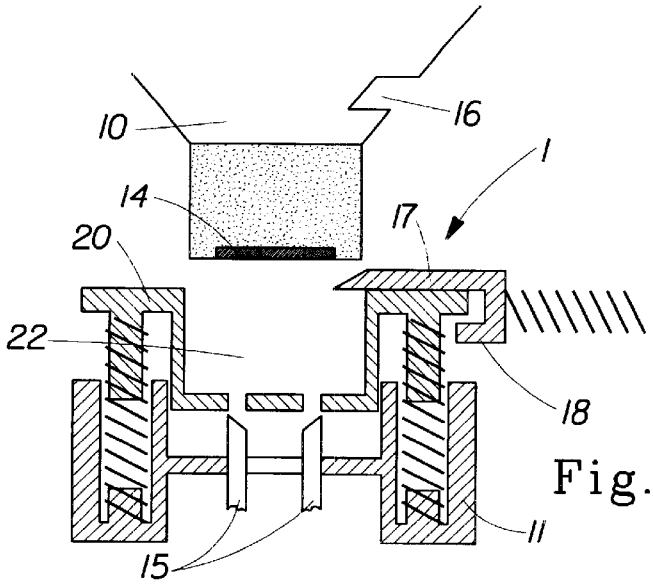
FIGS. 1A to 1C are schematic cross sectional side views of a preferred dispensing appliance made in accordance with the present invention, wherein the reservoir is respectively disconnected, partially connected and fully connected to the dispensing appliance.

Reference will now be made in detail to the present preferred embodiments of the invention, examples of which are illustrated in the accompanying drawings wherein like numerals indicate the same elements throughout the views. Referring to FIGS. 1 to 4, a device 1 is provided for dispensing a liquid product onto a surface, such as a cleaning product for treating carpets or other large fabric coverings. The device 1 comprises the combination of a reservoir 10 for containing the liquid product with an appliance for dispensing the product. Any type of device comprising a dispensing appliance and a reservoir can use a fitment as hereafter described, in order to establish a fluid communication between said reservoir and said dispensing appliance. However, in the rest of the present description, and for clarity purposes, one embodiment of a dispensing appliance 11 is described in more detail, which preferably comprises a housing, a spraying arm 12, and a means for conducting the liquid product from the reservoir 10 to the spraying arm.

Preferably, the dispensing appliance 11 comprises a manually or electrically driven pump. More preferably, said dispensing appliance 11 comprises an electrically driven pump which is used to pump product from the reservoir 10 through the spraying arm and out of the product dispensing opening (or openings) located in the spraying arm, to the surface to be treated. The product dispensing openings are preferably nozzles which are selected so that the sprayed product takes the form of a continuous stream or film, or of a discontinuous stream or film of fine particles, or of a mist, or of a foam. It is most preferred that the spray pattern is in the form of fine particles because this is the most efficient way to cover a large surface area with a small volume of product with an even coverage. Typically the product output is from about 20 ml/minute to about 400 ml/minute, and preferably from about 150 ml/minute to about 250 ml/minute, the product being typically suitable for carpet cleaning or hard surface cleaning.

It is preferred that the spray arm 12 has one nozzle 13, but it may also have multiple nozzles located along its length. The spray arm 12 makes it easier to control where the cleaning product is sprayed. For example, when cleaning carpets the spray arm 12 makes it easier to avoid spraying product onto furniture and walls, and also enables access into corners which would otherwise be difficult to reach. Furthermore, an ergonomically designed spray arm 12 avoids the need for the user to have a bent back when spraying. The spray arm 12 is preferably extendible and/or detachable from the dispensing means housing.

The dispensing appliance 11 includes a means for conducting the liquid product from the reservoir 10 through the spray arm 12, to the product dispensing opening from which the liquid product is dispensed. The conducting means is connected to the reservoir 10 and to the spray arm 12, for example via pipes, which can be for example flexible plastic pipes, and more importantly, through a fitment system which is hereafter described in more detail. The means for conducting the product from the reservoir 10 to the spray arm 12 is preferably contained into the housing, as well as the pipes, if any.

As shown schematically in FIG. 1, the dispensing appliance 11 further comprises a piercing means, or a pierceable means that fits respectively a corresponding pierceable means or piercing means of the reservoir 10. Preferably, said dispensing appliance comprises a piercing means which fits into a corresponding pierceable means of the reservoir. More preferably, the piercing means of the dispensing appliance is achieved by at least one needle 15, which fits with a pierceable means of the reservoir 10, as shown in FIGS. 1 to 2. Also more preferably, the pierceable means of the reservoir is integrated to a cap that closes said reservoir. Even more preferably, the pierceable means is an elastomeric membrane (or septum) and the appliance comprises two needles, one being connected to the pumping means, the other one comprising a one-way valve or venting membrane for letting air enter the reservoir 10 while the contents is removed therefrom, thus playing the role of a venting system.

Alternatively, said piercing means is located onto the reservoir, and said pierceable means is located into the appliance. In the rest of the present description, only the preferred embodiment featuring the needle(s) onto the appliance and the pierceable means onto the reservoir will be further discussed, but this should not be taken as a restriction to the scope of the present invention.

Figure 1B:
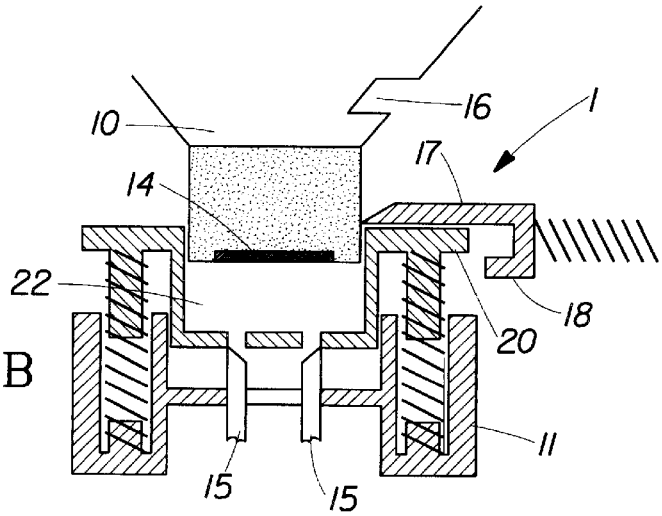
Figure 1C:
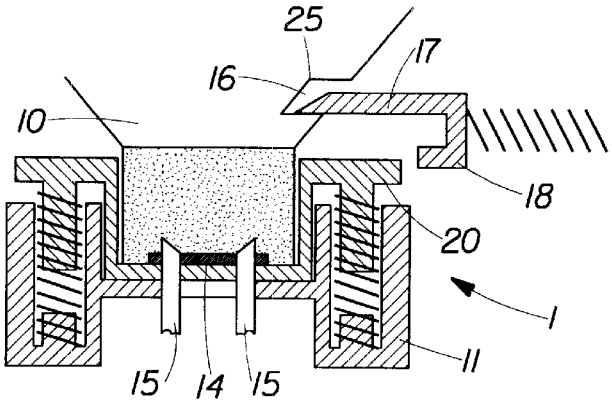

At first use, when the consumer inserts the reservoir 10 into the dispensing appliance 11, the elastomeric membrane 14 is pierced, as shown in FIG. 1C, so as to establish a leak-tight fluid communication between the interior of said reservoir 10 and the dispensing appliance 11. Then, the reservoir's contents is pumped through one needle 15, to the pump, up to the spray arm's nozzles, and is dispensed to the surface to treat. This provides a device wherein the operation of plugging/unplugging the reservoir from the housing of the dispensing means in order to establish a fluid, but leak-tight, communication between the two is very easy and obvious to the consumer.

In a particularly preferred embodiment of the present invention, the means for conducting the product from the reservoir 10 through the spray arm 12 to the product dispensing opening comprises an electrically driven pump. The electrically driven pump may be, for example, a gear pump, an impeller pump, a piston pump, a screw pump, a peristaltic pump, a diaphragm pump, or any other miniature pump. In one embodiment the pump is a gear pump with a typical speed between 6000 and 12000 rpm.

The electrically driven pump must be driven by a means such as an electric motor. The electric motor typically produces a torque between 1 and 80 mN.m. The electric motor must, in turn be provided with a power source. The power source may be either mains electricity (optionally via transformer), or it may be a throw-away battery, or rechargeable battery. Most preferred are one or more AA rechargeable or disposable batteries, the batteries being housed in the package. The voltage output of the battery is typically between 1.5 and 12 Volts, with a preferred output between 3 and 6 V.

In one embodiment of this invention, the pump is designed to be reversible, so that it can dispense liquid from the reservoir 10, and suck liquid from a surface, or only from the pipes of the dispensing appliance 11, back into the same or preferably another reservoir 10. Typically, only small amounts of liquid can be sucked back from a surface, and such a reversible pump is not intended to replace the use of a vacuum cleaner. Several ways of inverting the rotation of the pump can be used. In one example, the pump and motor are linked to a timer and an electronic circuit, such that after a defined time (eg. 15 seconds) the motor is not used, it automatically starts again, and its rotation side is reversed. As a result, the remaining product in the tubing and the extension of the dispensing appliance 11 is sucked back into the reservoir 10. As a consequence when replacing a product by another one, it is easy to change the product without mixing new and old products. For example, the consumer can use the dispensing appliance 11 for dispensing a first type of composition, then wait for the pump to suck back said first composition from the pipes, and then change the reservoir 10 or its contents to dispense a second composition without mixing of the two compositions inside the pipes.

In a preferred embodiment of the present invention, the dispensing appliance 11 comprises at least one recess and/or protrusion 17 to fit onto at least one corresponding protrusion and/or recess 16 of the reservoir, said reservoir 10 being releasably secured in a leak-tight manner into the dispensing appliance 11 such that fluid communication between said reservoir 10 and said means is established, only when said protrusion(s) and recess(es) are fitted into each other, and said protrusion(s) and said recess(es) 16 of said reservoir 10 have complementary shapes of said protrusion(s) and/or recess(es) 17 of said dispensing appliance 11. Preferably, the dispensing means comprises at least one protrusion that fits into a corresponding and complementary recess of the reservoir, as shown in FIGS. 1 to 4. Also preferably, said protrusion(s) and said recess(es) 16 of said reservoir 10 have exactly complementary shapes of said protrusion(s) and/or recess(es) 17 of said dispensing appliance 11. Indeed, it is preferred that all the contours of the reservoir fit all the contours of the recess of the dispensing means, thus providing enhanced maintain of said reservoir. However, the shape of the reservoir may be such that it differs from the shape of the dispensing means' housing but still fits therein, such that a fluid connection between the two is established. However, it will be easily understood that the risk of leakage is enhanced in case all the contours of the reservoir are not properly maintained by the contours of the dispensing means.

The device 1 is preferably hand-held, and therefore preferably comprises a holding means, which is more preferably integrated to the housing of the dispensing appliance 11. The holding means may be any sort of handle 18 which will allow the user to pick up the device 1 and to carry it to the place where the spraying is to be carried out. The handle 18 can be part of the reservoir 10 or of the housing of the dispensing appliance 11. It is likely that the device 1 will be carried around a whole room when a carpet is being cleaned, and/or will be manipulated in all directions during use. The handle 18 may be a simple protrusion or indentation which may be gripped by the user, or it may be a more sophisticated design for ergonomic reasons.

In one alternative embodiment of the present invention, the housing of the dispensing appliance 11 comprises a means allowing the user to carry it without using hands. In a first example, the housing comprises a clip which allows the user to hang said housing to a belt. In another example, the housing comprises at least one shoulder strap which allows to carry said housing on the shoulder/back. Other such means may be applied which allow the user to use both hands for other tasks.

The reservoir 10 can be of any type capable of containing a liquid product-by liquid it is meant to include embodiments when the product comprises a solid and a solvent for progressively dissolving said solid. Also included are liquids comprising small particles in suspension. The reservoir 10 can be made out of any suitable material, such as metal, alloy, glass, but is preferably made out of plastic. It comprises at least one compartment comprising at least one liquid composition. Also preferably, the reservoir is vented. This means that the reservoir 10 comprises a means for connection to the dispensing appliance 11, such that it provides fluid connection between the two and allows fluid to exit said reservoir into said dispensing appliance 11, but it also allows simultaneous admission of air back into the reservoir 10 to compensate the loss of contents. Indeed, while the contents is being removed from the reservoir, the same volume of gas or air needs to be replaced, otherwise, a depression is created which can stop the pump after a while. Some alternative solutions could be envisaged, such as for example a reservoir made of two portions, one rigid outer shell combined with a flexible collapsible inner pouch, or a flexible pouch, with at leat one rigid portion, for example the spout. In such a system, the inner pouch would progressively collapse during dispensing of the product, thus avoiding the need for replacement of the dispensed contents by a gas, and thus avoiding the need for a venting system. However, it has been found that such alternative systems are technically difficult to manufacture, and are expensive.

In a first embodiment, the dispensing appliance 11 comprises one reservoir 10 with one compartment, comprising one or more composition(s), preferably one composition. In a second embodiment, the dispensing appliance 11 comprises one reservoir 10 with at least two different compartments, each of which can comprise different compositions, for example non-miscible compositions or two chemically reacting solutions which react once mixed. Such a reservoir 10 is made for example by an extrusion blowing process. In a third embodiment, the dispensing appliance 11 comprises at least two separate reservoirs. These reservoirs can have different shapes, for example they can be designed with complementary shapes. Alternatively, different reservoirs can be plugged into the dispensing appliance 11 at different locations. Said reservoirs can comprise one or more compartments comprising same, but most preferably different products. In a fourth embodiment, the dispensing appliance 11 comprises at least one portion for connecting a reservoir 10 comprising a liquid such as a solvent or water, and at least one additional portion for connecting a small cartridge of a concentrated composition, for example under liquid, gel or granulated form. At the time the consumer uses the dispensing appliance 11, the composition contained into the cartridge will be dissolved into the solvent or water, and the resultant active liquid composition will be dispensed through the spray nozzle 13. Alternatively, said cartridge is connected directly into one portion of a reservoir 10. The cartridge can be for example screwed into an appropriate opening of the housing, or of the reservoir 10. It comprises a seal portion, such that when fully screwed, it sealably closes said appropriate opening.

In all of the preceding embodiments, when the dispensing appliance 11 comprises more than one reservoir 10, the proportion of product pumped can differ from one reservoir 10 to another. For example, this is achieved by selecting pipes of different diameters for a reservoir 10 and another, or by adding a flow-control means to the pipes between one reservoir 10 and the pump.

In another embodiment, a kit is also provided which comprises the dispensing appliance 11 and at least one reservoir 10 comprising a product, said appliance and said reservoir being fitted by a fitment as per the present invention. Preferably, the kit comprises the dispensing appliance 11 and a set of several removable reservoirs, each comprising a different product. The different products can be products for treating different areas such as carpets, kitchen surfaces, bathroom surfaces, cars or else.

Figure 6:
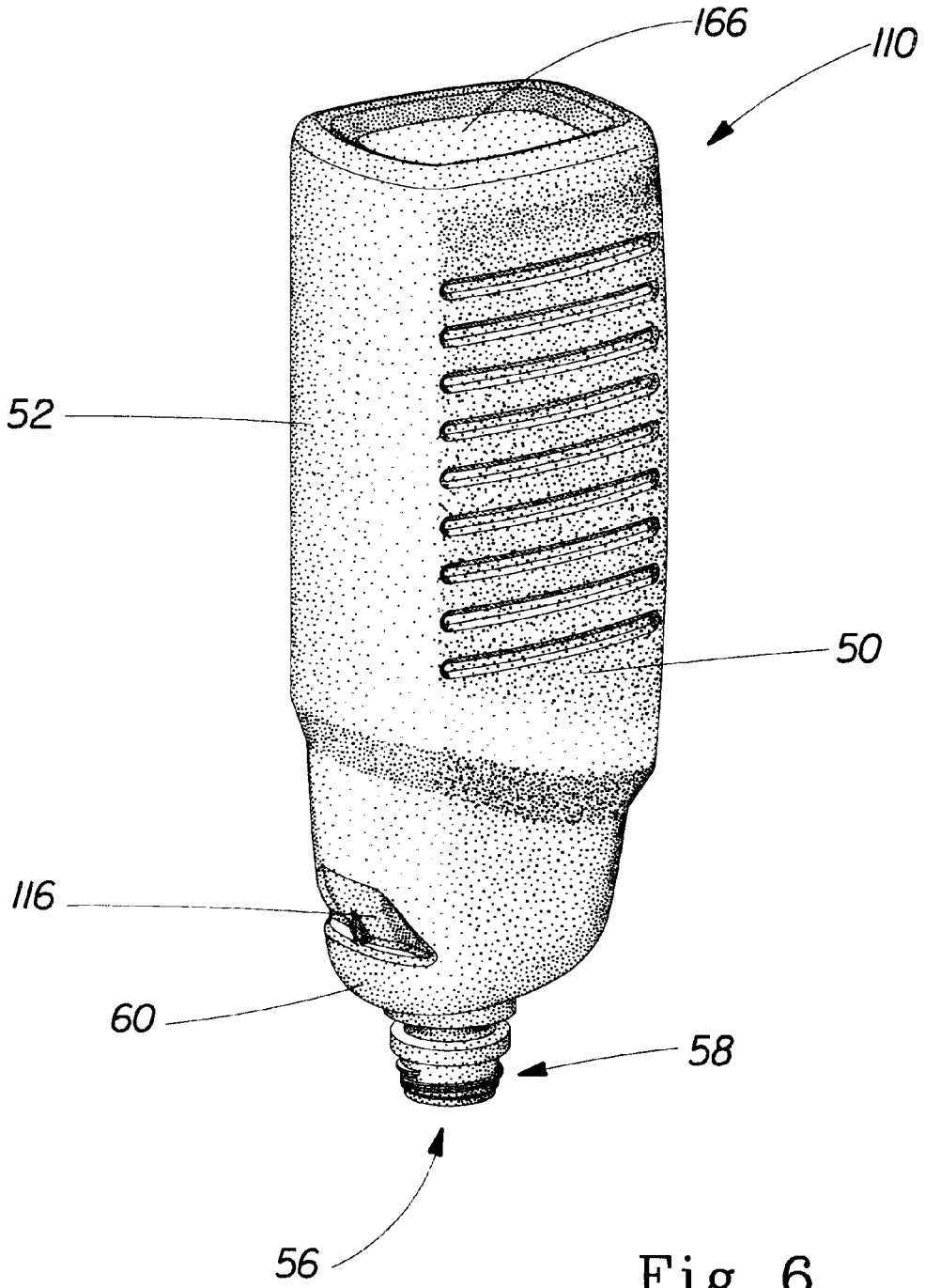
FIG. 6 is a perspective view of a preferred reservoir made in accordance with the present invention and suitable for use with the dispensing appliance of FIG. 5.
Figure 7:
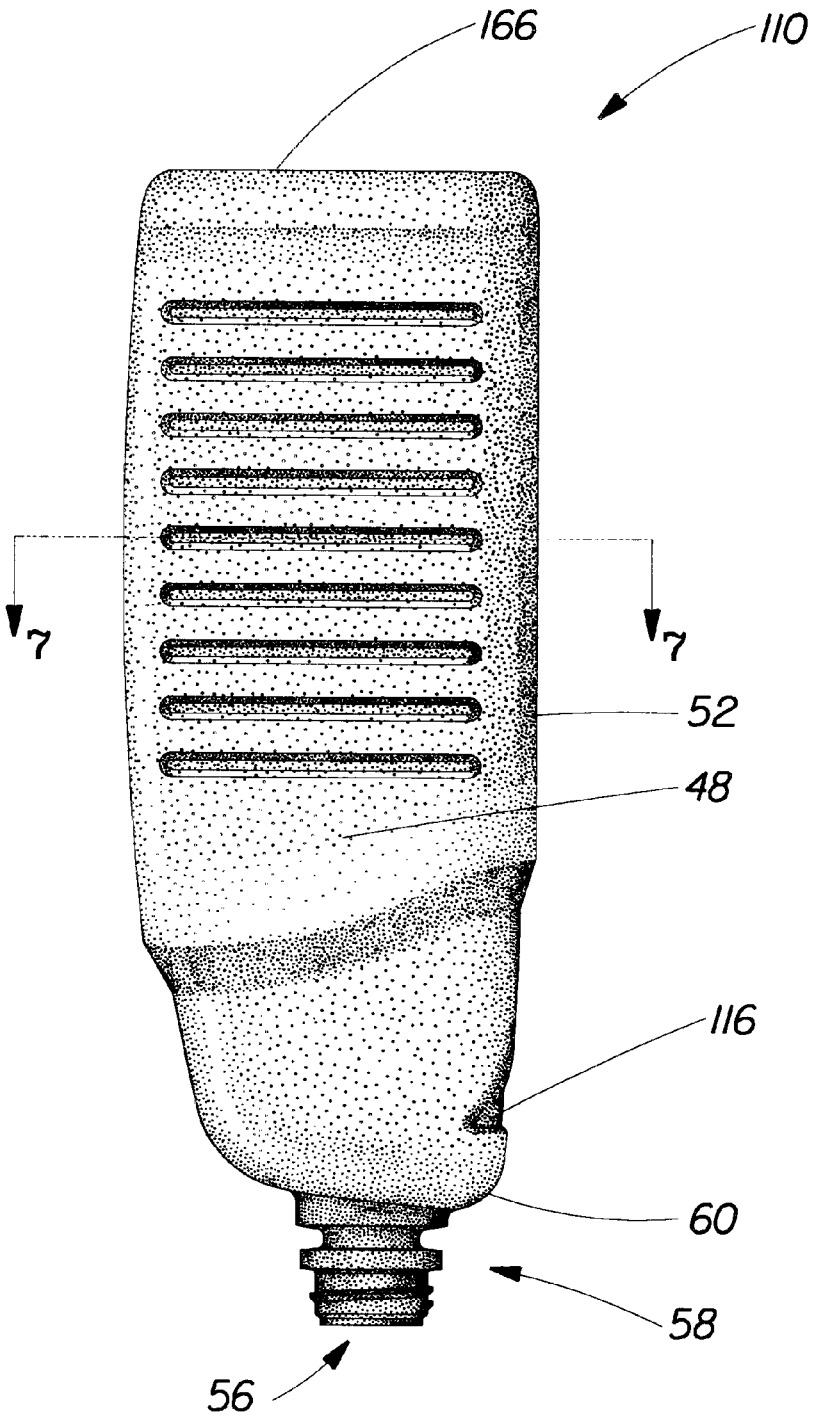
FIG. 7 is a side elevational view of the reservoir of FIG. 6.

In a particularly preferred embodiment of the present invention, the neck 19 of the reservoir 10 is off-centered in the cross sectional plan of the said reservoir 10 relatively to the central axis of said reservoir 10, and the reservoir 10 is non-cylindrical. This is best shown in FIGS. 6 and 7. Such a shape prevents the reservoir 10 from moving laterally and/or rotationally into the dispensing means housing, especially during use, thus preventing leakage.

In a preferred embodiment of the present invention, the reservoir 10 comprises at least one recess and/or protrusion 16 to fit into at least one corresponding protrusion and/or recess 17 of the device's dispensing appliance 11, said reservoir 10 being releasably secured in a leak-tight manner into the dispensing appliance 11 such that fluid communication between said reservoir 10 and said means is established, only when said protrusion(s) and recess(es) are fitted into each other, and said protrusion(s) and said recess(es) 16 of said reservoir 10 have complementary shapes of said protrusion(s) and/or recess(es) 17 of said dispensing appliance 11. Preferably, the reservoir 10 comprises at least one recess 16 that fits to a corresponding and complementary protrusion 17 of the dispensing appliance 11, as shown in FIGS. 1 to 4. Also preferably, said protrusion(s) and said recess(es) 16 of said reservoir 10 have exactly complementary shapes of said protrusion(s) and/or recess(es) 17 of said dispensing appliance 11, for the reasons explained above. The recess can be an integral part of the reservoir's walls, but alternatively, said recess is created when a cap is secured onto the neck of said reservoir, said cap having a greater external diameter than the external diameter of the reservoir's neck.

It has been shown that devices which comprise the assembling of a dispensing appliance and a reservoir, and which are subject to movements in all directions during use, are subject to leakage between said reservoir 10 and said dispensing appliance 11. This leads to spilling of product onto unexpected areas, which is clearly messy, and can even be dangeros, depending on the nature of the product which is dispensed. Preferably, the reservoir 10 which is provided is non-cylindrical, and has a off-centered neck 19. This provides stability and prevents lateral and rotational movements of said reservoir 10 within the dispensing means's housing. Especially, the non-cylindrical shape of the reservoirs prevents rotational movements. However, there can still be some leakage due to axial movement of the reservoir 10 (i.e. along the longitudinal axis of the reservoir). In order to prevent such axial movements, the device 1 is further preferably provided with a releasable locking mechanism 25 between the reservoir 10 and the housing of the appliance. Thus, it is a highly preferred feature of the present invention that the reservoir 10 comprises at least one recess and/or protrusion and the dispensing appliance 11 comprises at least one corresponding protrusion and/or recess, said reservoir 10 being releasably secured in a leak-tight manner with the dispensing appliance 11 such that fluid communication between said reservoir 10 and said means is established, only when said protrusion(s) and recess(es) are fitted into each other, and said protrusion(s) and said recess(es) of said reservoir 10 have a shape which is complementary to said protrusion(s) and/or recess(es) of said dispensing appliance 11. Preferably, said protrusion(s) and said recess(es) 16 of said reservoir 10 have exactly complementary shapes of said protrusion(s) and/or recess(es) 17 of said dispensing appliance 11, for the reasons explained above.

In a first embodiment, and as shown in FIGS. 1A to 1C, the reservoir 10 comprises one recess 16 which is located in one of its lateral walls, i.e. in its body portion. The dispensing appliance 11 comprises one protrusion 17 which is positioned such that when the needle 15 of said dispensing appliance 11 has pierced the elastomeric membrane 14 of the reservoir's cap, and a fluid communication is established between the two, the protrusion 17 exactly fits into the recess 16. In this way, the reservoir 10 is tightly maintained into the housing of the appliance 11, thus preventing leakage of product at the interface between the needle 15 and the pierceable means 14.

In a second embodiment of the present invention, as shown in FIGS. 3A to 3F, the reservoir 10 comprises one recess which is located near the top, for example on the neck 19, or directly on the cap 28, or alternatively, the recess is constituted by the difference of external diameter between the neck 19 of the bottle and the cap 28 itself. In the latter case, if the external diameter of the cap 28 is greater than the external diameter of the reservoir's neck 19, a recess is created at the time the cap is secured onto said neck. The dispensing appliance 11 comprises one protrusion which is positioned such that when the needle 15 of said dispensing appliance 11 has pierced the rubber septum 14 of the reservoir's cap 28, and a fluid communication is established between the two, the protrusion exactly fits into the recess. This second embodiment might be preferred to the first one. Indeed, the reservoir is preferably manufactured with a blow-molding process. Thus, tolerances in the reservoir are not as precise as the tolerance of a piece which is injection molded. There is a need for high accuracy in the mating of the locking fitment system to prevent movement of the reservoir 10 within the dispensing means housing. This is highly critical in the region of the connection between the needle 15 and the elastomeric membrane 14, where the risk of leakage is the highest. It was found that by minimizing the distance between the locking mechanism 25 and the membrane/needle fitment, the reservoir 10 is better held in place into the housing, in the region of the membrane/needle fitment.

In any case, it is a preferred feature of the device 1 according to the present invention, that the at least one recess and/or protrusion of the reservoir 10 is located at less than 25 cm, preferably less than 20 cm, more preferably less than 10 cm from the top of said reservoir 10.

As shown in FIGS. 1A to 1C, it is highly preferred that the locking mechanism 25 between the reservoir 10 and the dispensing appliance 11 be releasable. To this effect, the at least one protrusion is movable, such that it can be engaged/disengaged from the corresponding recess(es). This is preferably achieved by providing a locking mechanism 25 which is of the push-button type, press-button type, or any other suitable means for releasing the at least one protrusion from the at least one recess. More preferably, the locking mechanism 25 is a push-button releasable locking mechanism 25. It comprises a movable protrusion 17 which is mounted with a spring means 27, for example an helicoidal metallic spring 27, or a plastic spring blade. The protrusion 17 is connected to a push button, which is accessible to the consumer from the outside of the device's housing. When the reservoir 10 is in place and locked into the housing, the user can exert a push on the button, to release the protrusion 17 from the reservoir's recess, and remove said reservoir 10 from the device 11.

The protrusion can have any shape, as long as it is an exact complementary shape of the recess. For example, in can be a simple pin, but it can also be a hook, or it can even have more complex shape, as door keys have.

The dispensing appliance 11 preferably comprises two needles 15: one is for dispensing of liquid from the reservoir, the other one is for admission of air back into said reservoir, so as to ensure that the loss of contents in said reservoir is compensated. Such a connection system ensures that the reservoir is correctly vented, thus ensuring proper continuous pumping and dispensing of its contents. But alternatively, the venting of the reservoir can be achieved by a one-way valve, or by a venting membrane. The reservoir 10 can be fixed into the housing of the dispensing appliance 11, and then, preferably comprises one opening, more preferably a reclosable opening. Alternatively, the at least one reservoir 10 can be removable from the housing of the dispensing appliance 11, so that it is replaceable when empty, or it can be refilled, for example with tap water. As hereafter described in more detail, it is an essential feature of the present invention that the needles 15 which are mounted in the appliance 11 are protected from access by a consumer, by a spring loaded protecting plate 20 which prevents access to said needles 15 when the appliance contains no reservoir 10, and which frees the access to the needles 15 whenever a reservoir 10 is fully inserted into said appliance 11.

In a highly preferred embodiment of the present invention, the spring-loaded movable protrusion 17 which releasably locks the reservoir 10 inside the dispensing appliance's recess is further provided with a means (such as the extension 18 which engages the underside of the protecting plate 20 in the locked position of FIG. 1*a*) for locking the protecting plate 20 into the position wherein it prevents access to the needles 15, as shown in FIG. 1A. This provides a double security, since the protecting plate 20 cannot be moved without first pressing onto the movable protrusion. Practically, the coordinated movement of pressing onto said movable protrusion, and at the same time, moving the protecting plate 20 to access the needles 15, cannot be done accidentally since said movable protrusion, and said protecting plate 20 are not located at the same place. It is even more difficult for a child that would play with the appliance, even for a long time. Thus, this system of linking the locking mechanism 25 to the spring-loaded protecting plate 20 provides additional benefit to the device 1 as a child-resistant feature.

Figure 2A:
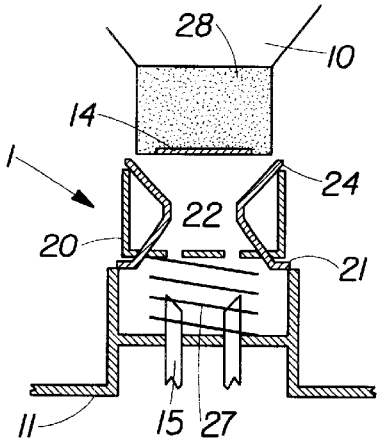
FIGS. 2A to 2D are schematic cross sectional side views of another preferred dispensing appliance made in accordance with the present invention, wherein the reservoir is respectively disconnected, partially connected and fully connected to the dispensing appliance.
Figure 2B:
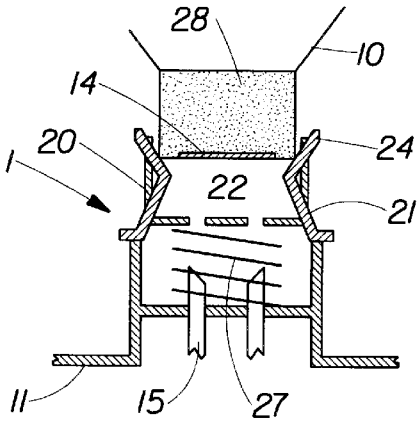
Figure 2C:
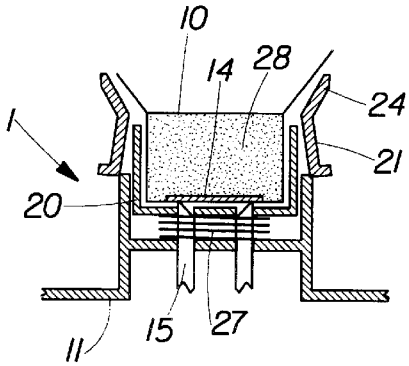
Figure 2D:
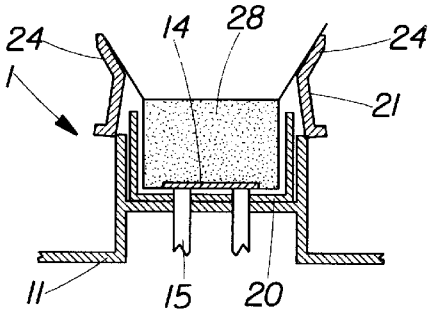
Figure 3:
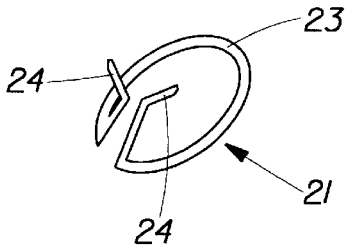
FIG. 3 is a perspective view of a preferred spring for biasing the protecting plate of the dispensing appliance of FIG. 1.
Figure 4:
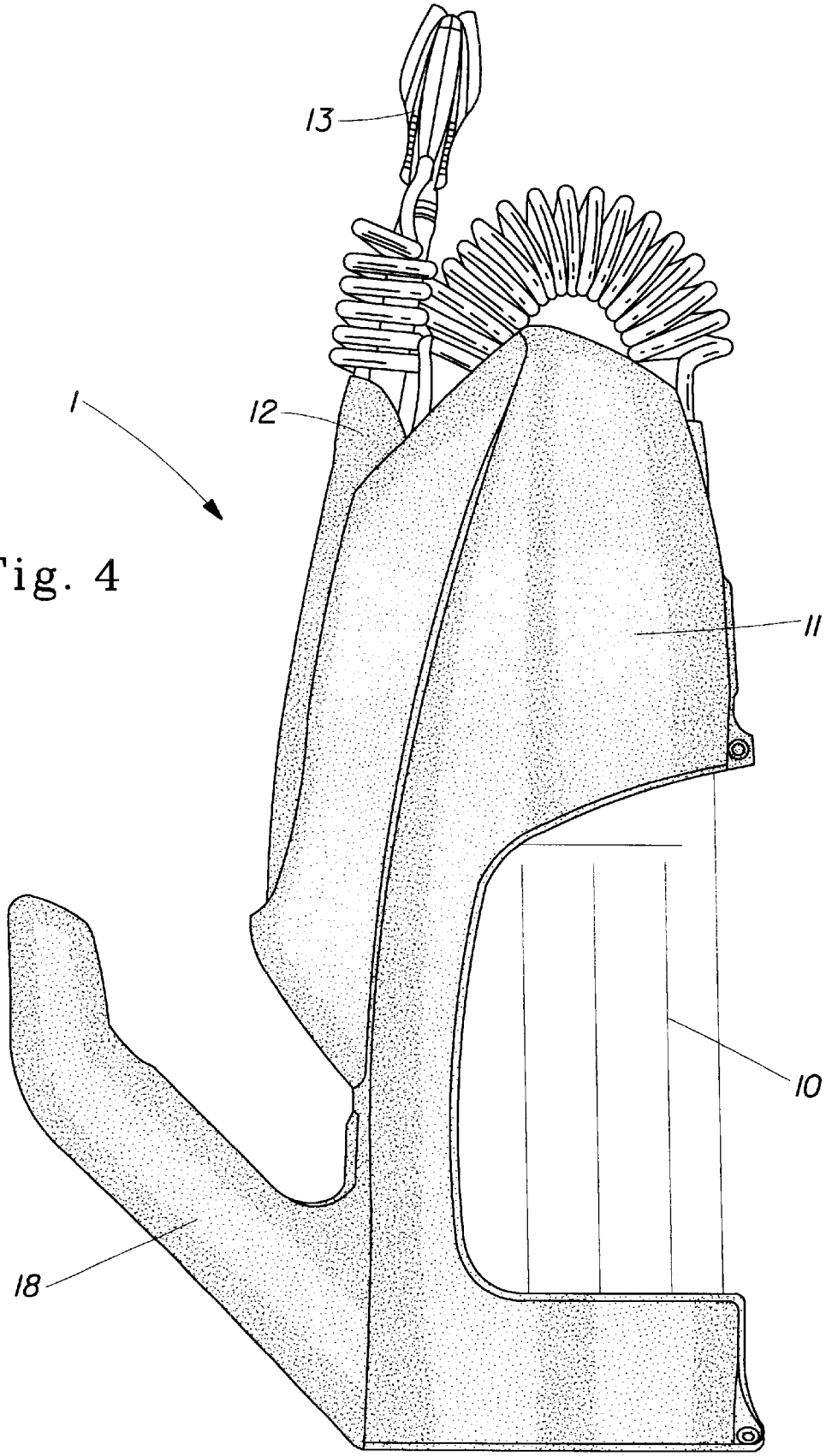
FIG. 4 is a side view of a dispensing appliance suitable for use with the present invention with a reservoir inserted therein.
Figure 5:
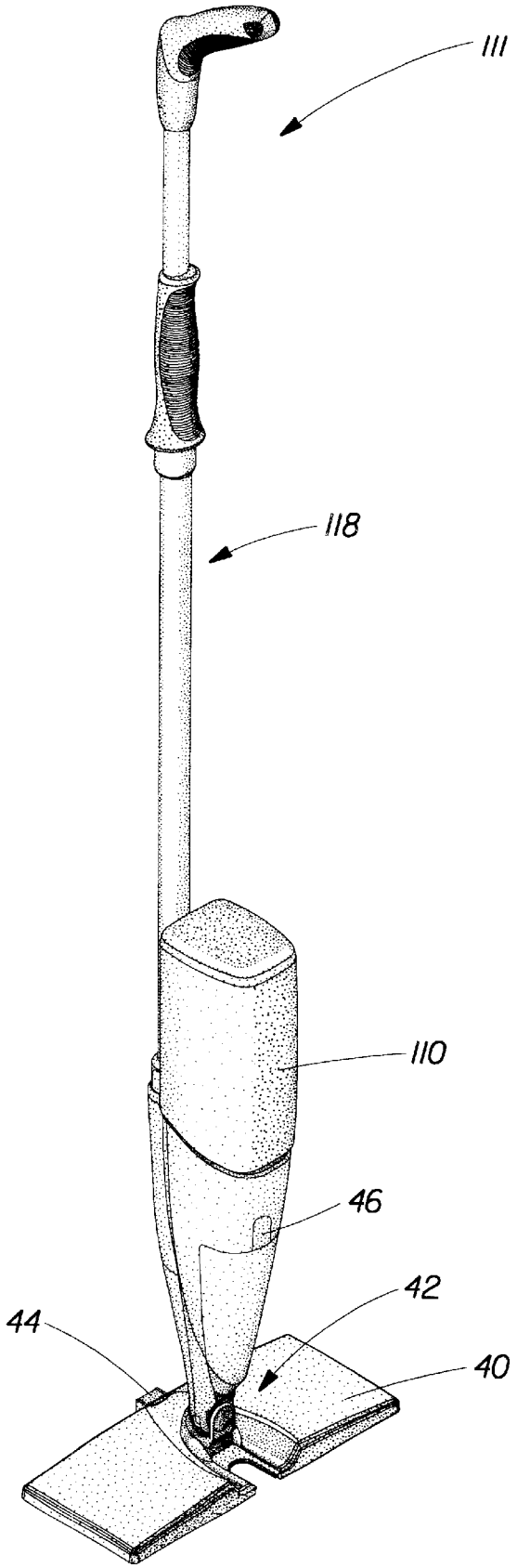
FIG. 5 is a perspective view of another dispensing appliance suitable for use with the present invention with a reservoir inserted therein.

In a second embodiment of the present invention, the protecting plate 20 is secured in locked position while preventing access to the needles by a circlip 21, as shown in FIGS. 2A to 2D. As shown in FIG. 3, the circlip 21 is a flexible, substantially circular spring, preferably made out of metal, but which can be made out of any other suitable flexible material. Said circlip comprises a main ring 23 which is discontinued in its median portion, and two extensions 24 of this main ring 23 extending upwardly. Said circlip 21 is inserted between the fitment of the appliance 11 and the protecting plate 20. In normal position, the main ring 23 of the circlip has a diameter which is lower than the external diameter of the base of the protecting plate 20, such that said protecting plate cannot move down to the bottom of the appliance's fitment, and thus it is locked in "needle-protecting" position. Whenever the reservoir 10 is inserted into the appliance 11, said reservoir's shoulders push onto the extensions 24 of the circlip 21, with the effect that it increases the diameter of the main ring 23, as shown in FIGS. 2C and 2D, such that said diameter of the main ring 23 becomes greater than the external diameter of the protecting plate 20. Thus, said protecting plate 20 is free to slide down and to give access to the needles 15 that pierce the membrane 14 of the reservoir, as shown in FIG. 2D.

As it has been previously described, the reservoir 10 is fitted to the dispensing appliance 11 by means of at least one piercing means 15—for example at least one needle 15—which punctures at least one pierceable means 14. Preferably, said at least one needle 15 is located into a recess of the appliance, into which said reservoir 10 is normally placed during use, and said pierceable means 14 is located onto the reservoir 10. The at least one needle 15 which is used for the present invention may have several shapes or constitutive materials such as stainless steel, tantalum, zirconium . . . etc., but preferably, it is made out of metal stainless steel 304 or similar stainless steel. More preferably it has an outside diameter comprised within the range of 0.7 to 7 mm, and more preferably an outside diameter comprised within the range of 0.7 to 2.5 mm. Also preferably, it has an internal diameter comprised within the range of 0.5 to 2 mm, and even more preferably, an inside diameter comprised within the range of 0.5 to 1.5 mm. In case said at least one needle is a bevel-edged needle, it preferably has a tip angle comprised within the range of 15° to 30°, and even more preferably, said needle 15 has a tip angle of 21°. However, other shapes for a needle can be used.

It has been found that bevel-edged needles may be at least partially obstructed by a portion of the membrane, which may render the appliance non-functional. This is due to the fact that the heel of the needle's bevel is very sharp, and at the time the needle is inserted into the membrane, said sharp heel may poke out a little portion of the membrane, which then slides into the needle's channel, leading to obstruction of said channel. One solution to avoid that problem is to use a non-coring needle, which is defined as a needle that is designed and manufactured such that it cannot poke out a portion of the material wherein said needle is inserted. There are different types of non-coring needles. For example, it can be achieved by sand-blasting the heel of the bevel, so as to erode it, until it loses its sharpness. Alternatively, the needle can be shaped like a pencil tip, with its hole located on a lateral side of the needle, and not on the tip itself, so that no beveled sharp edges can cut and detach a portion of the pierceable material.-Alternatively, the needle's tip can be in the shape of a scalpel blade, with the hole located on a lateral side of the needle, not on the blade itself, so that no beveled sharp edge can be cut and detach a portion of the pierceable material. Such non-coring needles are known in the art, and the skilled person may appropriately chose the right shape and size for a needle, to meet the purpose of the present invention.

It has been found that after removing the reservoir 10 from the appliance, the needle 15 is accessible by anyone who would put his hand into the appliance's recess. Such needles 15 are typically very sharp, and likely to cause injury upon contact, more particularly if some dispensed product remains on it. This is true for any type of user, but especially true for children. Indeed, it has been shown that children are very curious and while playing, they tend to put their hands into the recess of the dispensing appliance 11. Thus the protecting means 20 prevents access to said at least one needle 15, unless said reservoir 10 is connected to said appliance.

Preferably, as shown in FIGS. 1A to 1C, the protecting means 20 is a movable protecting plate 20. More preferably, said protecting plate 20 comprises a recess 22 in the shape of the cap. Said protecting plate 20 is spring loaded, so that it automatically returns to a position in which access to the needles 15 is prevented, whenever the reservoir 10 is removed from the appliance. Any type of spring can be used, but preferably, the springs 27 are helicoidal springs 27, as shown in FIGS. 1A to 1C. At the time the reservoir 10 is inserted into the neck 19 of the appliance, its neck 19 and/or closure push against said protecting plate 20 so that the needles 15 are accessible, and can pierce the pierceable means 14 to establish a fluid communication in a leak-tight manner between said reservoir 10 and said dispensing appliance 11.

After removing the reservoir 10 from the appliance, the user might be in a situation where a certain amount of product remains in said reservoir 10, for example in case the user would like to temporarily use the dispensing appliance 11 for dispensing another type of product. In this case, the remaining product may well leak through the open pierceable means 14 of the reservoir 10, which is clearly undesirable to the consumer. Also, during usage of the device 1, it is essential that the fitment between the reservoir 10 and the dispensing appliance 11 is leak-tight, so as to prevent that liquid can contact the interior of the appliance. Indeed in some cases, said appliance is electrical, so any leakage of liquid inside the electrical circuits may lead to damage to the appliance, or even to injuries to the user, which is of course clearly undesirable.

In the following description, for clarity purposes, the sole embodiment wherein the pierceable means 14 of the reservoir 10 is a pierceable membrane 14 will be discussed. However, this should not limit the scope of the present invention, since the pierceable means 14 may alternatively be achieved in other ways. For example, the pierceable means 14 can be one portion of the reservoir's wall which is for example molded integrally with said reservoir 10) by a co-injection molding process, also it can be a portion which is added to the walls of the reservoir 10 by means of gluing or welding process.

After the reservoir 10 has been in place within the appliance for one month or more, it has been shown that most known membranes stay in a deformed configuration, more particularly, they keep the form of the needle 15 that was piercing through, in the shape of one or more holes, which of course renders the container subject to leakage. This phenomenon is usually called setting-up and appears within a few weeks after the needle 15 has been inserted. Surprisingly, it has been found that a pierceable membrane 14 as described hereafter provides excellent leak-tightness once it is pierced by the needles 15 of the appliance. Moreover, it shows the very good advantage that, once the reservoir 10 is removed from said appliance, said membrane 14 recloses in such a way that setting-up, and thus leakage is prevented, even after the reservoir 10 has been in place within the appliance for one month or more. Such a membrane is preferred in the context of a fitment according to the present invention.

This is achieved by making a membrane 14 which does not take a set after having been pierced. It has been found that this effect can be achieved by making the membrane 14 out of at least one layer of one or more material(s), including at least one layer of an elastomeric material. Preferably, the membrane 14 is made out of at least one layer elastomeric material that will provide good reclosability properties, that is to say, whenever the membrane 14) is pierced and even though the piercing means 15 stays into the membrane 14 over a long period of time, the elastomeric layer will prevent the membrane 14 from taking a set, and it will ensure that once the piercing means 15—for example the needle 15—is removed from the membrane 14, said membrane 14 will retrieve its initial—closed —shape, so as to prevent leakage. Additional layers made out of different materials may be used, for example one layer of a material that is chemically resistant to the reservoir 10 contents may constitute the inner layer of the membrane 14. Alternatively, materials such as metal, plastic, aluminum, alloys, paper or cardboard, Teflon, or any other suitable material may be added to the layer of elastomeric material, in any combination of layers.

In a first and preferred embodiment, the membrane 14 is made out of one layer of silicone, which provides excellent material memory, as well as good chemical resistance to the reservoir's contents. In a second embodiment, the membrane 14 is made out of a combination of silicon and an inert PET. Silicon provides excellent memory to the materials, so that the membrane 14 will close back after having been pierced, whereas inert PET provides chemical resistance to the product contained inside the reservoir 10. In a most preferred embodiment of the present invention, the elastomeric membrane 14 is made out of two layers: one inner layer out of inert PET, which comes in contact to the inside of the reservoir 10 and is especially meant to chemically resist to its contents, and an outer layer which is on contact with the atmosphere, and is made out of a silicone.

In both of the preceding embodiments, the thickness of the membrane 14 can influence on the memory of the material. Preferably, the membrane 14 has a thickness less than 1 cm, more preferably, less then 6 mm, and even more preferably less than 4 mm, all thicknesses being measured in the portion of the membrane 14 which is comprised in the middle portion of said membrane 14, i.e. in the region which will be pierced (see FIG. 2).

The membrane 14 can have any suitable shape, but preferably it has a circular shape, with an overall diameter preferably comprised within the range of 0.5 to 5 cm and more preferably comprised within the range of 0.7 to 2 cm. It has been shown that a ratio of 3.6 mm thickness in the middle pierceable portion, for 1 cm overall diameter, provides good memory properties for a one layer silicon membrane 14, and prevents setting-up in a very good manner.

As previously described, the pierceable membrane 14 may be part of the appliance, but preferably, it is part of the reservoir 10 or the cap 28 closing said reservoir 10, and in the most preferred embodiment of the present invention, said pierceable membrane 14 is attached to the top portion of the cap 28. It must be attached in such a way that it is very difficult to remove it without using a tool. It can be mechanically inserted by means of ribs that fit into grooves, as shown in FIG. 2, or it can be attached by some other means, such as for example heat sealing, gluing, welding. It can also be co-injected in the same injection mold, together with the cap itself which provides the advantage of being cheap to produce. In case it is made out of silicon or similar elastomeric material, the membrane 14 can also be cast-molded, and then UV-cured.

The cap can have any suitable shape, for example it can have a truncated profile, as shown in FIG. 2. It can be screwed onto the neck 19 of the reservoir 10, for example by means of one or several screw threads, but it can also be secured by any other suitable means, such as bayonet fitment means, clipping means, or similar. However, a device 1 using a fitment according to the present invention is even better achieved if the reservoir 10 is equipped with a pierceable cap with silicon membrane 14, as previously described, wherein said cap can be secured onto the neck 19 of said reservoir 10, but cannot be removed. In such an embodiment, the reservoir 10 is difficult to open by children, because if the adult user needs to remove the reservoir 10 from the appliance when said reservoir 10 is not yet empty, the product contained inside said reservoir 10 cannot leak because the pierceable membrane 14 recloses upon removal of the reservoir 10, and the cap cannot even be removed without using a tool and using a substantial amount of lever force. This means that there is low chance for a kid to get in contact with the composition contained inside. Such non-removable fitment can be achieved by any suitable means, such as for example screw threads with non return triangular lugs, which allow screwing of the cap, but whereby unscrewing is prevented.

Figure 8:
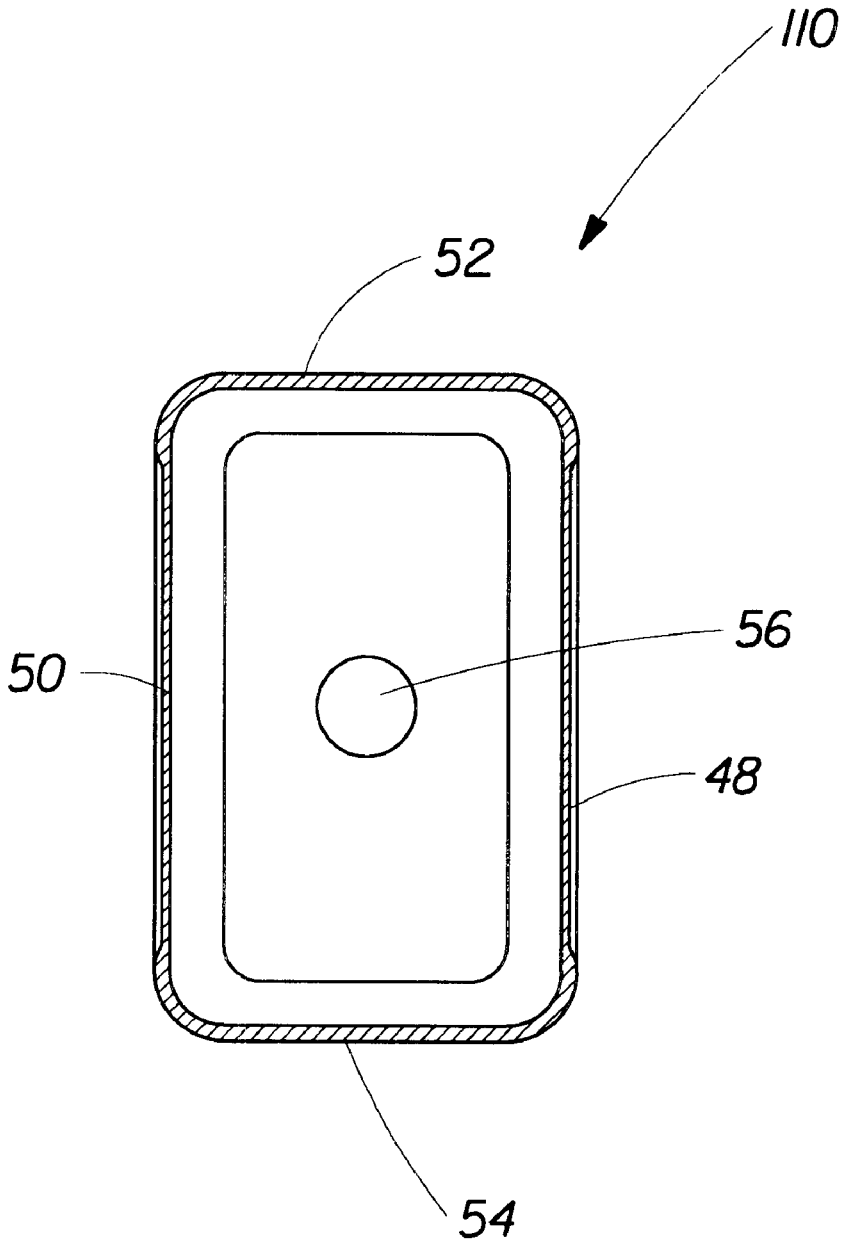
FIG. 8 cross sectional plan view of the reservoir of FIG. 7, taken along line 8—8 thereof.
Figure 9:
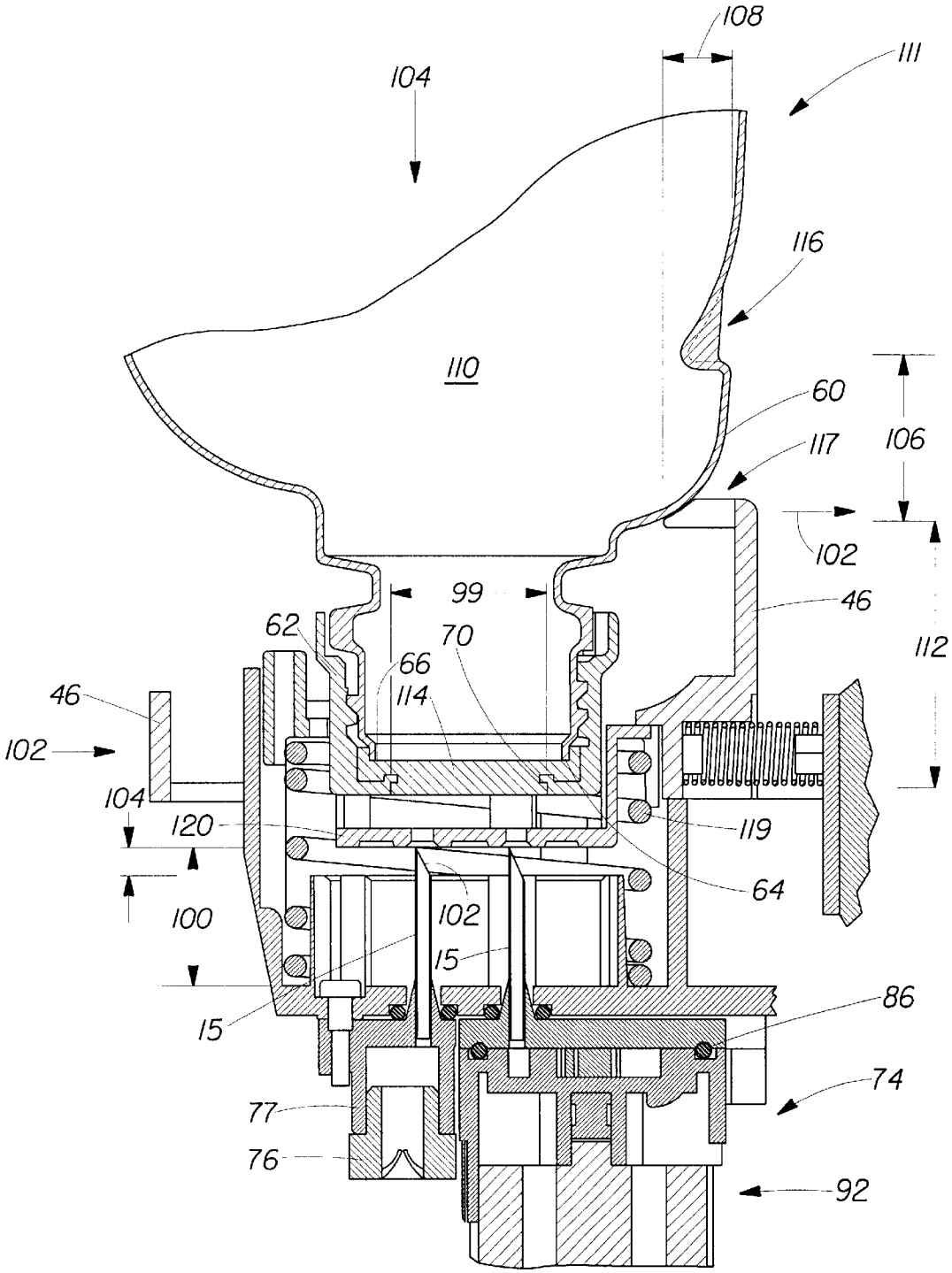
FIG. 9 is a partial cross-sectional side view of the housing of the dispensing appliance of FIG. 5, wherein the reservoir is shown at initial contact with the protrusion of the latch.
Figure 10:
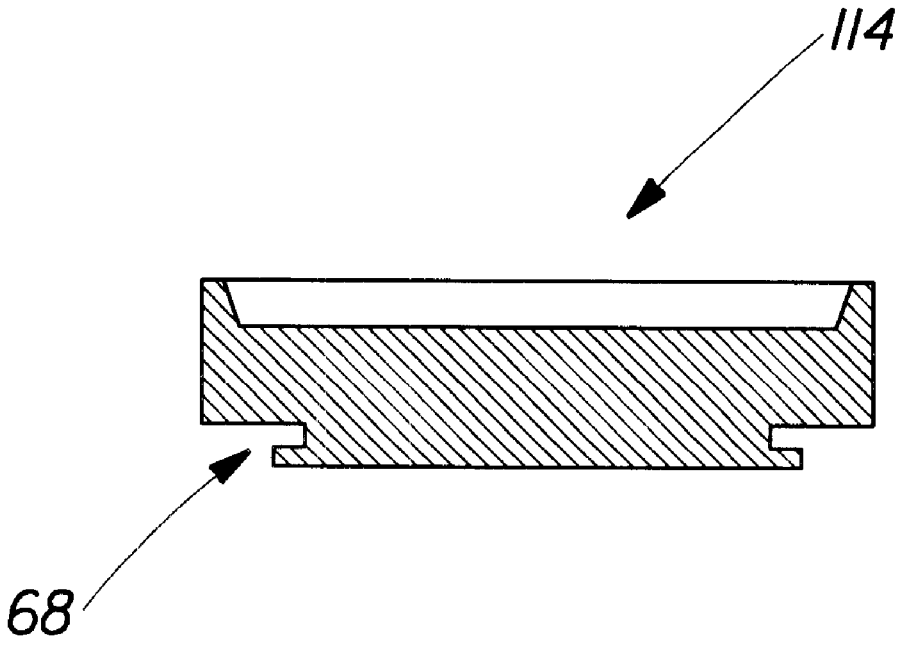
FIG. 10 is a cross-sectional side view of the membrane of the reservoir of FIG. 9.

Referring to FIGS. 5 to 11, another preferred device comprising a dispensing appliance in the form of a floor mop 111 and a reservoir 110 is illustrated. The floor mop 111 comprises a handle 118 formed from a plurality of sections, a mop head 40 attached to the handle by a universal joint 42, and a liquid delivery system which includes a spray nozzle 44 attached to the upper plate of the mop head 40 adjacent to its leading edge such that the spray nozzle 44 can move in the direction of the mop head 40 when the mop 111 is maneuvered. A latch 46 engages a recess 116 of the reservoir 110 to secure the reservoir 110 in place, as discussed more fully hereafter. Further description of the floor mop 111 can be found in U.S. provisional patent application Ser. No. 60/199,444, filed Apr. 25, 2000. As shown in FIGS. 6 to 8, the removable reservoir 110 comprises opposed first and second side walls 48 and 50 and opposed third and fourth side walls 52 and 54. The plan cross-sectional view of the bottle is preferably substantially in the form of a parallelogram or rectangular in order to aid alignment of the reservoir 110 when it is inserted into the housing of the floor mop 111 and to provide a more aesthetically pleasing appearance. A bottom wall 166 is interconnected with each of the side walls to form a hollow container. The reservoir 110 has an opening 56 formed in the finish 58 and an actuation surface 60 preferably formed in the transition portion of the reservoir 110 between the finish 58 and one of the side walls. The recess 116 is preferably formed in the side wall 52 of the reservoir 110 for engaging the protrusion 117 of the latch 46 of the floor mop 111, as discussed more fully hereafter. While the reservoir 110 is shown with only one finish, it is contemplated that additional finishes and openings can be provided. For example, the bottom wall 166 can include an additional finish and opening for refilling the reservoir 110 while it is installed in the floor mop 111. The reservoir 110 further comprises a cap 62 (FIG. 9) and a membrane 114 which is disposed over the opening 56 of the reservoir 110. As previously discussed, the membrane 114 is preferably formed from silicone. As best seen in FIG. 9, the membrane is disposed between the rim 64 of the opening 56 and the inner surface 66 of the cap 62. The cap 62 threadably engages the finish 58 of the reservoir 110. As shown in FIGS. 9 and 10, the membrane 114 has an annular recess 68 which engages a lip 70 of the cap 62.

Figure 11:
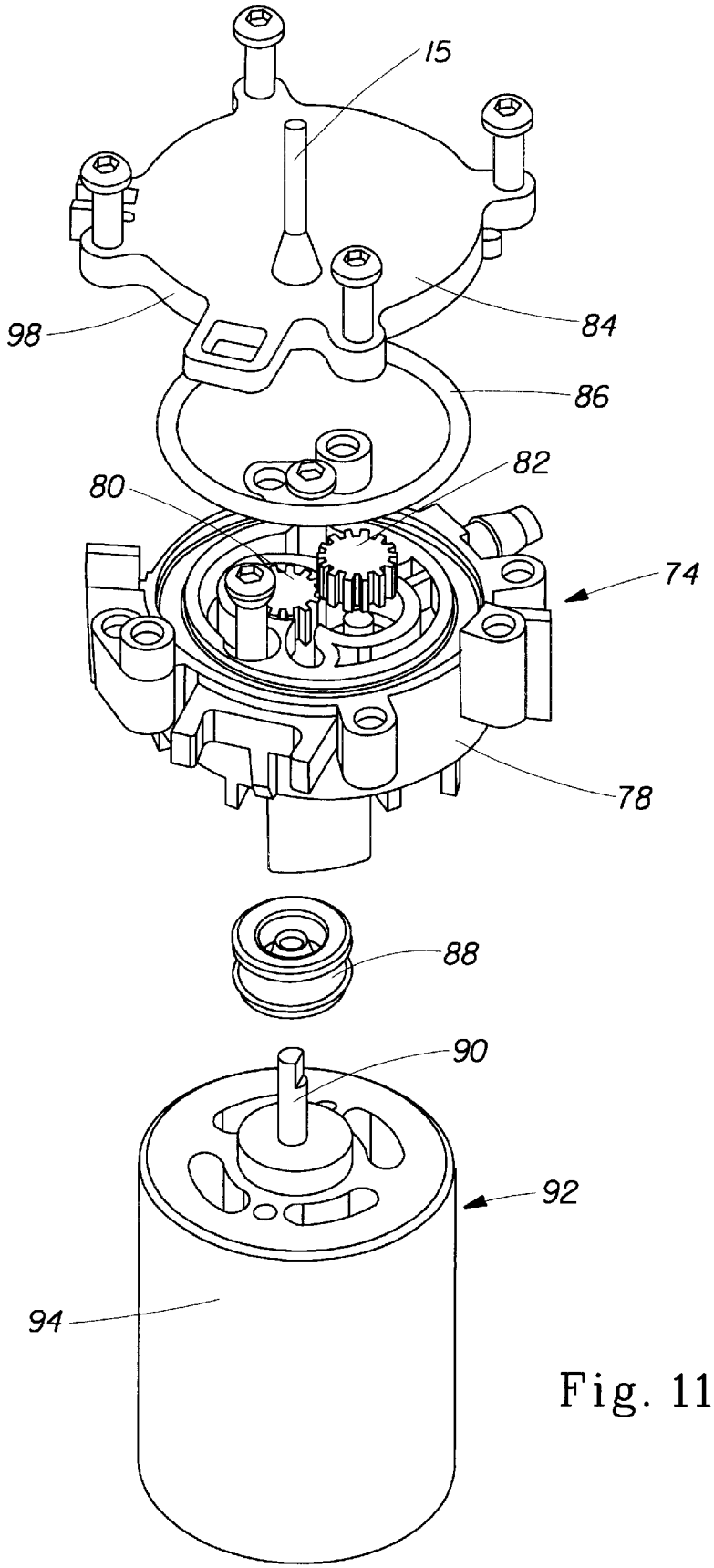
FIG. 11 is an exploded perspective view of the pump and electric motor of the dispensing appliance of FIG. 9.

Referring to FIGS. 9 and 11, the piercing means again comprises two hollow needles 15, wherein one needle 15 is disposed above the inlet 72 of the gear pump 74 while the second needle 15 communicates with a vent module 76. The gear pump 74 comprises a pump housing 78, a drive gear 80, an idler gear 82, a face plate 84 having the needle 15 which communicates with the inlet for the pump, a first seal 86 in the form of an O-ring disposed between the pump housing 78 and the face plate 84, and a second seal 88 about the motor shaft 90 of the electric motor 92. The pump housing 78 is directly attached to the motor housing 94 of the electrical motor 92 by two screws, wherein the drive gear 80 is disposed between the screws and the drive gear 80 is directly attached to the shaft 90 of the electrical motor 92. More preferably, the drive gear 80 is keyed to the shaft 90 and the shaft 90 passes through the motor casing 94. The minimum outside diameter of the motor casing is generally dictated by the motor configuration (e.g., shaft diameter and rotor diameter) which in turn is driven by motor performance. The gear pump housing 78 also preferably engages the motor casing 94 when the screws threadably engage the casing screw holes in order to provide a compact configuration.

The minimum distance between the needles 15 is greater than about 2 mm so that there is adequate space to locate the o-ring seal 86 between the peripheral edge 98 of the top plate 84 and the pump inlet while accommodating a vent module directly adjacent to, but outside of for simplicity, the pump 74 and electric motor 92. The vent module comprises a transition piece 77 which communicates with the second needle 15. A one-way or check valve 76 is inserted at least partially within the transition piece 77. The check valve 76 can be provided in the form of a mushroom valve, a duck bill valve, or any valve known in the art which is suitable for permitting an air flow through the second needle 15 and into the reservoir 110 after the membrane 114 has been pierced by the needle. The maximum distance between the needles 15 is between about 20 mm and about 40 mm in order to accommodate an elastomeric membrane which does not buckle during use. More particularly, the membrane 114 is preferably formed from silicone (or any of the other previously described materials for the membrane 14) for resealability following removal of the reservoir from the floor mop 111. If the diameter of the membrane 114 is too large and/or the size of the needles is too short, the needles may not fully penetrate the thickness of the membrane 114 due to inward bowing of the flexible silicone membrane and the short length of the needles. It has been found that the distance between the needles 15 is also preferably less than about 35 mm and, more preferably, is between about 5 mm and about 20 mm in order to provide a membrane length which minimizes the bowing effect. Most preferably, the distance between the needles 15 is between about 8 mm and about 13 mm in order to accommodate a closely spaced vent module 76 while assuring full penetration of the membrane 114 during use. The needles 15 preferably have a height 100 between about 2 mm and about 20 mm with a tapered tip 102 having a length 104 between about 1 mm and about 6 mm. Needles of this size in combination with the previously described membrane 114 size and configuration permit adequate penetration of the membrane, minimize the possibility of forming a "plug" of material which will block the hollow tips of the needles 15 during piercing of the membrane 114, and account for the use (e.g., the thickness of the protective plate) of a protecting plate 120. Correspondingly, the exposed length of the membrane 114 preferably mirrors the spacing of the needles 15. As used herein, the phrase "exposed length" is intended to refer to the length 99 of the membrane 114 over which one or more of the needles act (i.e., the distance across the membrane 114 to which the needles 15 are exposed). For example, for the circular membrane 114, the exposed length is the diameter of the circle which is exposed to the needles. While the exposed length 99 of the membrane 114 of FIG. 9 is shown as extending across both needles 15, it is contemplated that two membranes, one for each needle, could be provided in place of the single membrane 114, wherein each of the two membranes would have a separate exposed length relative to its respective needle. Thus, the exposed length of the membrane is less than about 45 mm and, more preferably, is between about 1.5 mm and about 20 mm.

Figure 12:
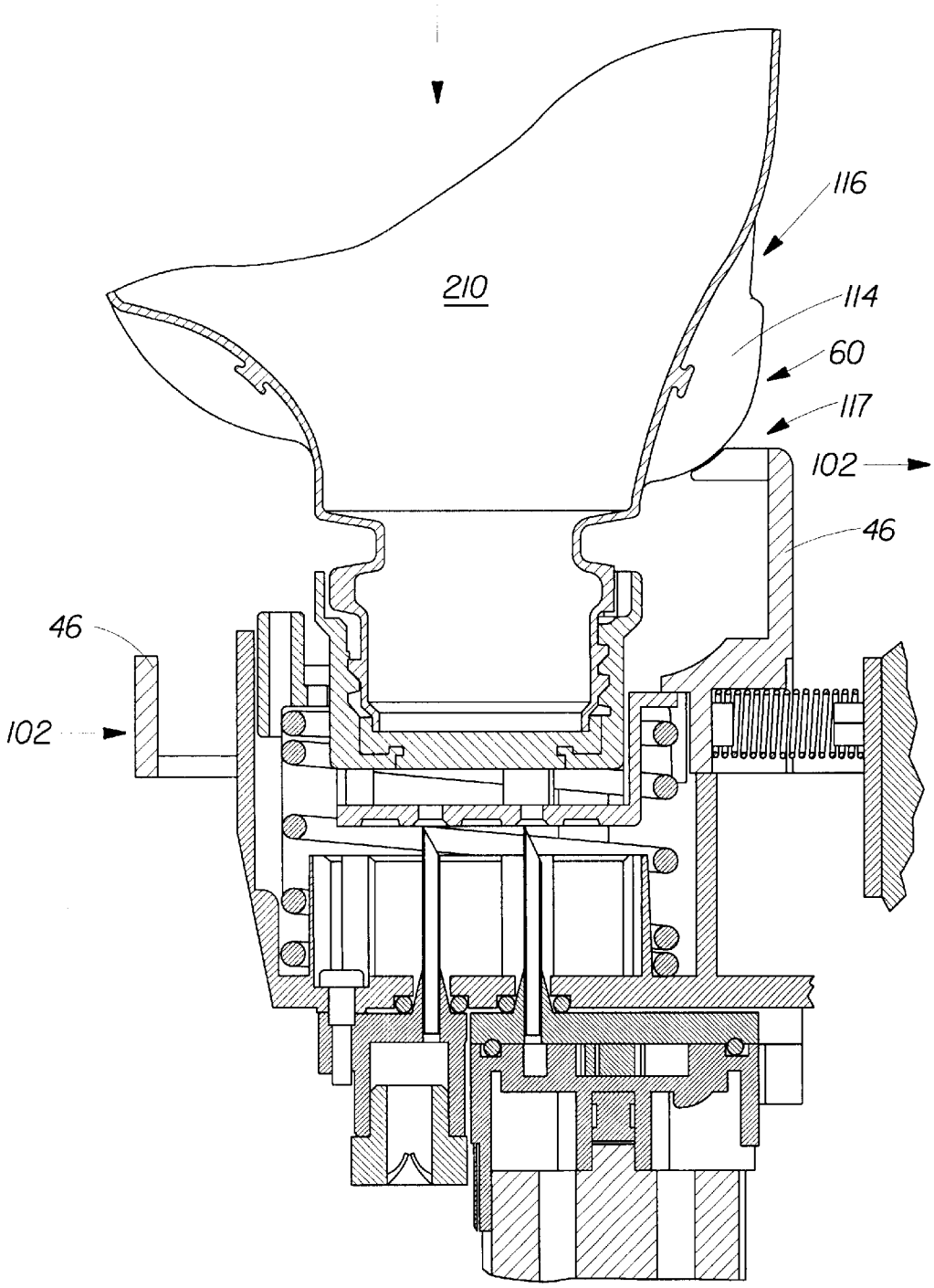
FIG. 12 is a partial cross-sectional side view of another preferred dispensing appliance, wherein the reservoir further comprises an adapter.

The actuation surface 60 cooperates with the protrusion 117 of the latch 46 to unlock the protecting plate 120 in order to expose the needles 15 as the reservoir 110 is pushed downwardly into the housing of the floor mop 111. As previously described with respect to the dispensing appliance 11 and as shown schematically in FIG. 1, an extension (not shown in FIG. 9) of the spring-biased latch 46 resists downward movement of the protecting plate 120 in the locked position so that the needles 15 are not exposed. In a particularly preferred embodiment, the protrusion 117 is pushed in the direction of arrows 102 by either the actuation surface 60 as the reservoir 110 is pushed downwardly in the direction of arrow 104 into the protecting plate 120 or by application of hand pressure to the translating latch 46. In either case, translation of the latch 46 and its extension 18 thereby disengages the extension 18 from the protecting plate 120 and unlocks the protecting plate 120 so that the protecting plate 120 can translate downwardly when the cap 62 contacts the protecting plate 120. The actuation surface of the reservoir 110 is preferably disposed or located radially (i.e., in a direction transverse to the longitudinal axis of the reservoir) and axially (i.e., in a direction parallel to the longitudinal axis of the reservoir) from the membrane 114. The phrase "actuation surface" is intended to refer to the entire surface over which the protrusion cooperates during insertion and/or removal of the reservoir 110. More preferably, the actuation surface 60 is curvilinear, wherein the curved portion is convex in shape. The actuation surface 60 has a working length 106 and a working depth 108. As used herein, the phrases "working length" and "working depth" are intended to refer to the projection distances over which the protrusion 117 cooperates with the actuation surface 60 of the reservoir 110 during use. For example with reference to FIG. 9, distances 106 (the working length) and 108 (the working depth) represent projection distances of the actuation surface 60 in planes parallel and transverse to the longitudinal axis of the reservoir 110, respectively. Over the working length and depth, the protrusion 117 cooperates with the actuation surface 60 to first unlock the protecting plate 120 and, second, secure the reservoir 110 against the biasing force of the spring 119 via engagement of the protrusion 117 with the recess 116 after adequate penetration of the membrane 114 by the needles 15. Preferably, the working length 106 (i.e., the projection distance from where the protrusion 117 first engages the actuation surface 60 to where the protrusion 117 engages the recess 116) is less than about 60 mm and, more preferably, is between about 4 mm and about 45 mm. Most preferably, the working length of the actuation surface is between about 15 mm and about 40 mm. The working depth 108 (i.e., the projection distance from where the protrusion 117 first engages the actuation surface 60 to the point of maximum radial retraction of the protrusion 117 while in contact with the actuation surface) is less than about 10 mm and, more preferably, is between about 2 mm and about 9 mm. Most preferably, the working depth is between about 3 mm and about 8 mm. The location distance 112 for the actuation surface 60 (i.e., the distance from the membrane 114 to the point where the protrusion 116 engages the actuation surface 60) is less than about 60 mm. As used herein, the phrase "location distance" is intended to refer to the projection distance in a plane parallel to the longitudinal axis of the reservoir from the exposed surface of the membrane 114 to the point where the actuation surface 60 begins, as shown in FIG. 9. Most preferably, the location distance 112 for the actuation surface is between about 1 mm and about 60 mm. While the actuation surface 60 for the reservoir 110 is shown and described as located in the transition portion between the finish 58 and the side walls of the reservoir 110, the actuation surface can be located on the cap or provided as a separate structure. For example, FIG. 12 illustrates a reservoir 210 comprising an adapter 114 having an actuation surface 60 which fitted to the reservoir 210, wherein the actuation surface 60 of the adapter 114 translates the latch 46/protrusion 117. In the foregoing embodiments, the reservoir 110 can be removed from the floor mop 111 by application of hand pressure to the spring biased latch 46 to translate the protrusion in the direction of arrows 102 until the protrusion 117 disengages the recess 116 thereby unlocking the reservoir from the floor mop, after which the spring biased protecting plate 120 will preferably translate the reservoir 110 upwardly.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A reservoir for use with a dispensing appliance for spraying a liquid active composition, wherein said dispensing appliance comprises at least two needles for engaging said reservoir and a protecting plate, said protecting plate having a locked position and an unlocked position, wherein said protecting plate is movable in said unlocked position to expose said needles and is immovable in said locked position, said reservoir comprising:

one or more side walls and a bottom wall defining a hollow container;

a finish disposed opposite said bottom wall with an opening which communicates with the interior of said container; and a needle-pierceable membrane disposed across said opening and having an exposed length of less than about 45 mm.

2. The reservoir of claim 1, wherein said exposed length is between about 1.5 mm and about 20 mm.

3. The reservoir of claim 1, wherein said membrane has a thickness of between about 0.3 mm and about 14 mm.

4. The reservoir of claim 3, wherein said membrane is formed from silicone.

5. The reservoir of claim 1, further comprising an actuation surface which is disposed axially and radially from said membrane, wherein said actuation surface is adapted to engage a protrusion of the dispensing appliance to unlock the protecting plate.

6. The reservoir of claim 5, wherein said actuation surface is the transition portion between said finish and one of said side walls.

7. The reservoir of claim 5, wherein said actuation surface has a location distance of less than about 60 mm from said membrane.

8. The reservoir of claim 5, wherein said actuation surface has a working length less than about 60 mm.

9. The reservoir of claim 1, further comprising a liquid.

10. The reservoir of claim 1, further comprising a cap threadably attached to said finish and wherein said membrane is disposed between an inside surface of said cap and said opening of said finish.

11. The reservoir of claim 5, wherein the working depth of said actuation surface is less than about 10 mm.

12. The reservoir of claim 11, wherein the working depth of said actuation surface is between about 3 mm and about 8 mm.

13. The reservoir of claim 11, further comprising a recess disposed in at least one of said side walls and adjacent said actuation surface.

14. The reservoir of claim 13, wherein said recess begins less than about 60 mm from said membrane.

15. A reservoir for use with a dispensing appliance for spraying a liquid active composition, wherein said dispensing appliance comprises at least two needles for engaging said reservoir, a protecting plate, said protecting plate having a locked position and an unlocked position wherein said protecting plate is movable in said unlocked position to expose said needles and is immovable in said locked position, and a latch having an extension which engages said protecting plate in said locked position and which disengages said protecting plate in said unlocked position, said reservoir comprising:

one or more side walls and a bottom wall defining a hollow container;

a finish disposed opposite said bottom wall with an opening which communicates with the interior of said container; and an actuation surface which cooperates with the protrusion of the latch to disengage the extension from the protecting plate in the unlocked position.

16. The reservoir of claim 15, wherein said actuation surface has a working length of less than about 60 mm.

17. The reservoir of claim 15, wherein said actuation surface has a working depth of less than about 8 mm.

18. The reservoir of claim 15, wherein said actuation surface is located in the transition portion between said finish and one of said side walls.

19. The reservoir of claim 18, further comprising a recess disposed adjacent said actuation surface.

20. The reservoir of claim 1 wherein said membrane is made of at least one layer of elastomeric material.

21. The reservoir of claim 1 wherein said membrane is a membrane capable of preventing leakage of a liquid contained in said reservoir when said membrane is pierced.

22. The reservoir of claim 10 wherein said membrane is integrated to said cap such that at least a portion of said membrane is engageable by a needle.

23. The reservoir of claim 9 wherein said liquid is a cleaning solution.

24. A method of inserting a reservoir in a dispensing appliance for spraying liquid active composition comprising:

providing a reservoir having one or more side walls, a bottom wall defining a hollow container, a finish disposed opposite said bottom wall with an opening which communicates with the interior of said container and a membrane disposed opposite said bottom wall with an opening which communicates with the interior of said container;

inserting said reservoir in a dispensing appliance for spraying a liquid, said dispensing appliance comprising at least two needles for engaging said reservoir, a protecting plate having an upward and a downward position and having a locked and an unlocked position, wherein said protecting plate is capable of exposing said needles when said protecting plate is in said unlocked position and is moved from said upward position to said downward position, such that said protecting plate is in said unlocked position and said protecting plate is moved from said upward position to said downward position whereby said needles engage said reservoir; and locking said protecting plate in said downward position.

25. The method of claim 24 wherein said reservoir contains a liquid active composition.

* * * * *